US009962965B2

(12) United States Patent
Mitsuo

(10) Patent No.: US 9,962,965 B2
(45) Date of Patent: May 8, 2018

(54) PRINTING APPARATUS AND METHOD FOR COMPRESSING PRINTING MEDIUM

(71) Applicant: SEIKO EPSON CORPORATION, Tokyo (JP)

(72) Inventor: Noritaka Mitsuo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/407,563

(22) Filed: Jan. 17, 2017

(65) Prior Publication Data

US 2017/0210150 A1 Jul. 27, 2017

(30) Foreign Application Priority Data

Jan. 21, 2016 (JP) ..... 2016-009510

(51) Int. Cl.

| | |
|---|---|
| ***B41J 25/308*** | (2006.01) |
| ***B41J 25/312*** | (2006.01) |
| ***B41J 13/00*** | (2006.01) |
| ***B41J 11/00*** | (2006.01) |
| ***B41J 3/407*** | (2006.01) |
| ***B41J 15/04*** | (2006.01) |

(52) U.S. Cl.

CPC ..... *B41J 13/0009* (2013.01); *B41J 3/4078* (2013.01); *B41J 11/002* (2013.01); *B41J 11/0005* (2013.01); *B41J 15/048* (2013.01)

(58) Field of Classification Search

CPC ..... B41J 25/308; B41J 25/304; B41J 13/00; B41J 13/0009; B41J 2/22; B41J 3/407; B41J 3/4078; B41J 11/00; B41J 11/0005; B41J 11/0015; B41J 11/002; B41J 11/0035; B41J 11/007; B41J 11/02; B41J 11/20; B41J 25/312

See application file for complete search history.

(56) References Cited

U.S. PATENT DOCUMENTS

2004/0095451 A1* 5/2004 Tatsumi ..... B41J 11/0015 347/101
2005/0174412 A1* 8/2005 Codos ..... B41J 2/01 347/102
2014/0265109 A1* 9/2014 de Jong ..... B65H 9/00 271/226
2014/0292907 A1* 10/2014 Chiba ..... B41J 11/007 347/29

(Continued)

FOREIGN PATENT DOCUMENTS

| | | | |
|---|---|---|---|
| EP | 2910381 | A1 | 8/2015 |
| EP | 2915677 | A1 | 9/2015 |
| JP | 2007-224436 | A | 9/2007 |

OTHER PUBLICATIONS

The Extended European Search Report for the corresponding European Patent Application No. 17152388.9 dated Jul. 9, 2017.

*Primary Examiner* — Geoffrey Mruk
*Assistant Examiner* — Scott A Richmond

(57) ABSTRACT

A printing apparatus includes an discharging head which discharges liquid on a printing medium mounted on an endless belt; a transport unit which transports the printing medium in a transport direction; a medium press portion which is provided on an upstream side of the discharging head in the transport direction and includes a medium pressing unit which compresses the printing medium; and a control portion which controls the medium press portion.

11 Claims, 8 Drawing Sheets

(56) References Cited

U.S. PATENT DOCUMENTS

2015/0239264 A1* 8/2015 Ishizuka ..... D06P 5/20
347/102
2015/0273866 A1 10/2015 Sakai

* cited by examiner

| PRINTING MEDIUM | PRESSING PRESSURE | TEMPERATURE |
|---|---|---|
| WOOL | (MEDIUM PRESSURE) TO (HIGH PRESSURE) | LOW MEDIUM TEMPERATURE |
| COTTON | (LOW PRESSURE) TO (MEDIUM PRESSURE) | MEDIUM HIGH TEMPERATURE |
| POLYESTER | (LOW PRESSURE) TO (MEDIUM PRESSURE) | LOW MEDIUM TEMPERATURE |

PRINTING APPARATUS AND METHOD FOR COMPRESSING PRINTING MEDIUM

BACKGROUND

1. Technical Field

The present invention relates to a printing apparatus and a method for compressing a printing medium.

2. Related Art

In the related art, an ink jet type of a printing apparatus is used which prints an image or the like on a printing medium by discharging liquid such as ink in droplet form from a discharging head having a nozzle toward a surface of the printing medium. It is desirable to process fluff just before printing so that reduction of printing quality by contact between the fluff and the discharging head with each other or attachment of a released fluff to the discharging head is prevented in advance, in a case where fabric of which the fluff is generated on a surface, or the like is used as the printing medium of the printing apparatus. A method for processing the fluff is disclosed in JP-A-2007-224436, for example, which is a method for thermally fusing a fluff layer by radiating a laser beam to the fluff layer.

A fluff processing described in JP-A-2007-224436 requires a laser irradiating device in order to irradiate fluff with a laser beam. However, providing the laser irradiating device on a printing apparatus is difficult due to increase in cost and safety issues of the apparatus. In addition, there is a problem that images are unclear by landing deviation of droplets being increased, in a case where printing is performed in a state a discharging head is raised with respect to a printing medium so that the fluff and the discharging head are not in contact with each other. Therefore, it is still difficult to provide the printing apparatus which forms images having excellent printing quality on the printing medium on which the fluff is generated.

SUMMARY

The invention can be realized in the following forms or application examples.

APPLICATION EXAMPLE 1

According to this application example, there is provided a printing apparatus including an discharging head which discharges liquid on a printing medium mounted on an endless belt; a transport unit which transports the printing medium in a transport direction; a medium press portion which is provided on an upstream side of the discharging head in the transport direction and includes a medium pressing unit which compresses the printing medium; and a control portion which controls the medium press portion.

According to the present application example, the printing apparatus includes the medium press portion which compresses the printing medium which is transported by the transport unit. In the printing medium including fluff, Opportunity of the contact between the discharging head and the printing medium with each other is reduced and thus defects such as nozzle missing and landing deviation which are generated by contact between the discharging head and the fluff with each other are less likely to be generated, since height of the fluff is lowered by the pressing pressure of the medium press unit. In addition, the discharging head can be set to be lowered, in accordance with the height of the printing medium (fluff) after compression. Therefore, images having excellent printing quality are formed on the printing medium on which the fluff is generated. Therefore, the printing apparatus which improves the printing quality can be provided.

APPLICATION EXAMPLE 2

It is preferable that the printing apparatus according to the application example further include an input unit to which printing condition including a type of the printing medium is input and that the control portion control pressing pressure of the medium pressing unit to be changeable according to the printing condition.

According to the application example, although an amount (density) or a length of the fluff of the printing medium changes according to the type of the printing medium, the printing apparatus of the application example can suitably compress the printing medium since the pressing pressure of the medium pressing unit is controlled to be changeable by the control portion when the printing medium is compressed according to the type of the printing medium which is input to the input unit.

APPLICATION EXAMPLE 3

In the printing apparatus according to the application example, it is preferable that the medium press portion include a medium heating unit which heats the printing medium and that the control portion control temperature of the medium heating unit to be changeable according to the printing condition.

According to the application example, the medium press portion can improve compressing efficiency of the printing medium since the medium press portion includes the medium heating unit which heats the printing medium when the printing medium is compressed. In addition, although the temperature which can be applied to the printing medium is different according to the type (material) of the printing medium, the printing apparatus according to the application example can suitably compress each printing medium which is made of different material from each other, since the temperature of the medium heating unit is controlled to be changeable by the control portion.

APPLICATION EXAMPLE 4

In the printing apparatus according to the application example, it is preferable that the printing condition include a distance between the endless belt and the discharging head and that the control portion control at least one of the pressing pressure and the temperature to be changeable according to the printing condition.

According to the application example, in the printing apparatus, at least one of the pressing pressure of the medium pressing unit and the temperature of the medium heating unit are controlled to be changeable by the control portion when the printing medium is compressed, according to the printing condition which includes the distance between the endless belt and the discharging head and the type of the printing medium. Accordingly, the printing medium is compressed to a suitable height with respect to the input distance between the endless belt and the discharging head.

APPLICATION EXAMPLE 5

It is preferable that the printing apparatus according to the application example further include a notifying portion which notifies with alarm according to the input printing condition.

According to the application example, the printing apparatus includes the notifying portion which notifies with the alarm in a case where the height of the printing medium cannot be compressed to be further lowered than the distance between the printing medium and the discharging head, or the like, in the printing condition including the input distance between the printing medium and the discharging head, for example. Accordingly, the print deteriorated in image quality can be prevented from being performed in advance.

APPLICATION EXAMPLE 6

According to this application example, there is provided a method for compressing a printing medium in a printing apparatus which includes an discharging head which discharges liquid on a printing medium mounted on an endless belt; a transport unit which transports the printing medium in a transport direction; a medium press portion which is provided on an upstream side of the discharging head in the transport direction and includes a medium pressing unit which compresses the printing medium; an input unit to which printing condition is input; and a control portion which controls the medium press portion. The method includes determining a condition when the printing medium is compressed according to the printing condition; and compressing the printing medium.

According to the application example, the method for compressing a printing medium includes determining a condition when the printing medium is compressed according to the printing condition which is input to the input unit; and compressing the printing medium. In the printing medium including fluff, opportunity of the contact between the discharging head and the printing medium with each other is reduced and thus defects such as nozzle missing and landing deviation which are generated by contact between the discharging head and the fluff with each other are less likely to be generated, since the fluff is compressed and thus the height of the printing medium is lowered by the determining of the condition and the compressing of the printing medium. In addition, the discharging head can be set to be lowered, in accordance with the height of the printing medium (fluff) after compression. Therefore, images having excellent printing quality are formed on the printing medium on which the fluff is generated. Therefore, the method for compressing the printing medium which can improve the printing quality can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described, with reference to drawings. Scales of each layer and each member are different from those of actual layers and actual members since each layer and each member have recognizable extent of sizes in the following drawings.

In addition, X axis, Y axis, and Z axis are illustrated as three axes which are perpendicular to each other for convenience of explanation in FIG. 1 to FIG. 3, and FIG. 8 to FIG. 10. A distal end side of an arrow which illustrates an axial direction is referred to as "+side" and a proximal end side thereof is referred to as "−side". In addition, a direction which is parallel to X axis is referred to as "X axis direction", a direction which is parallel to Y axis is referred to as "Y axis direction", and a direction which is parallel to Z axis is referred to as "Z axis direction", in the following.

Embodiment

Schematic Configuration of Printing Apparatus

Figure 1:
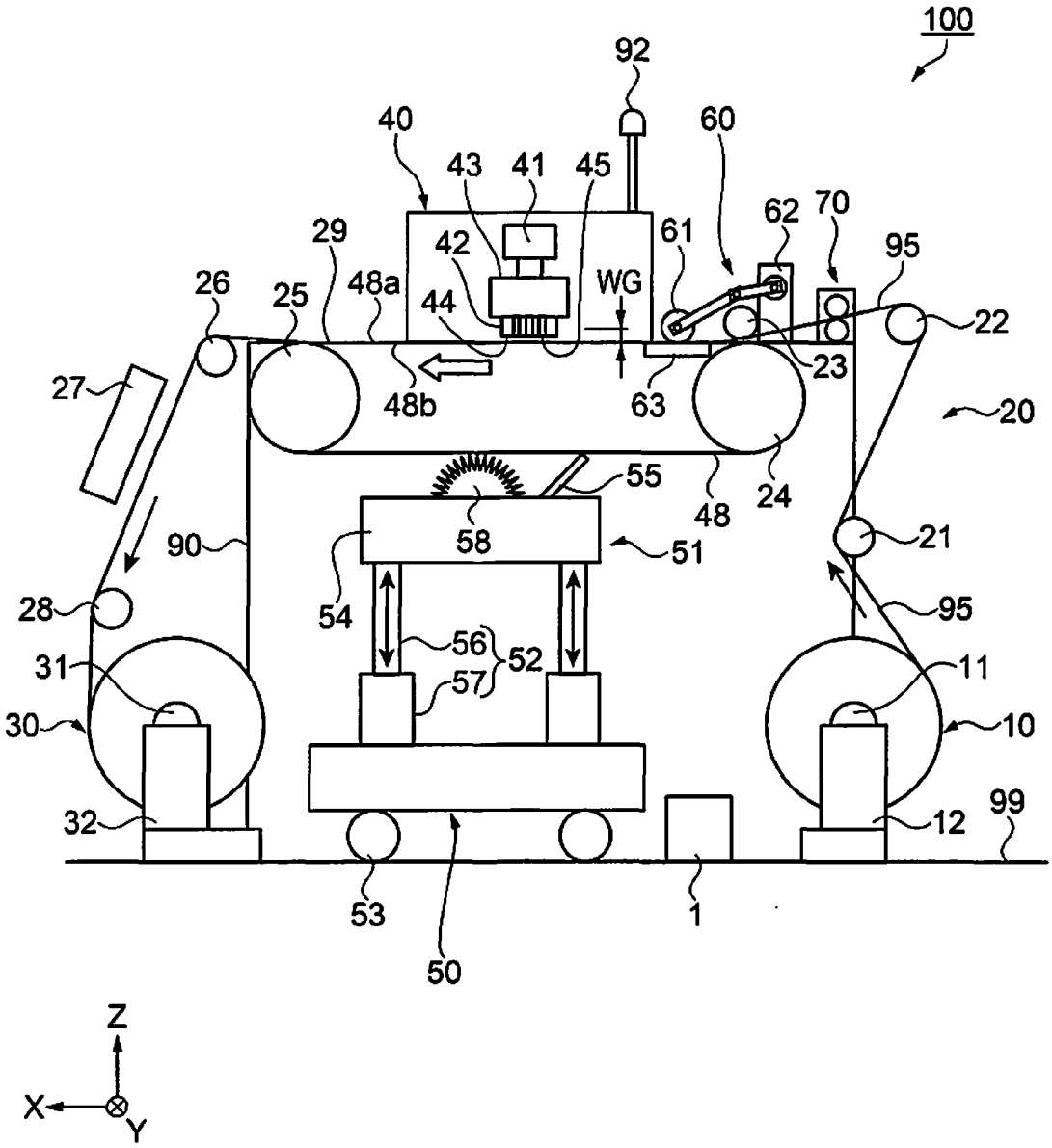
FIG. 1 is a schematic view illustrating overall configuration of a printing apparatus according to an embodiment.

FIG. 1 is a schematic view illustrating overall configuration of a printing apparatus according to an embodiment. First, with reference to FIG. 1, the schematic configuration of the printing apparatus 100 according to the embodiment will be described. In the embodiment, an ink jet type of a printing apparatus 100 which performs printing on a printing medium 95 by forming an image or the like on the printing medium 95 will be described.

As illustrated in FIG. 1, the printing apparatus 100 includes a medium transport portion 20, a medium press portion 70, a medium close contacting portion 60, a printing portion 40, a drying unit 27, a cleaning unit 50, and a notifying portion 92. The printing apparatus 100 includes a control portion 1 which controls each portion described above. Each portion of the printing apparatus 100 is attached to a frame portion 90.

The medium transport portion 20 is a transport unit which transports the printing medium 95 in a transport direction (+X axis direction in a printing portion 40). The medium transport portion 20 includes a medium supplying portion 10, transport rollers 21, 22, and 23, an endless belt 48, a belt rotating roller 24, a belt driving roller 25, transport rollers 26 and 28, and a medium collecting portion 30. First, a transport path of the printing medium 95 leading from the medium supplying portion 10 to the medium collecting portion 30 will be described.

The medium supplying portion 10 supplies the printing medium 95 on which an image is formed to the printing portion 40 side. Fabric such as cotton, wool, and polyester is used as the printing medium 95, as an example. The medium supplying portion 10 includes a supplying shaft portion 11 and a bearing portion 12. The supplying shaft portion 11 has a cylindrical shape or a columnar shape and is provided to be rotatable in a circumferential direction. The printing medium 95 having a strip shape is wound into a roll shape in the supplying shaft portion 11. The supplying shaft portion 11 is detachably attached to the bearing portion 12.

Therefore, the printing medium 95 in a state of being wound to the supplying shaft portion 11 in advance can be attached to the bearing portion 12 along with the supplying shaft portion 11.

The bearing portion 12 supports to be rotatable both ends of the supplying shaft portion 11 in an axial direction. The medium supplying portion 10 includes a rotation driving portion (not illustrated) which rotates and drives the supplying shaft portion 11. The rotation driving portion rotates the supplying shaft portion 11 in a direction in which the printing medium 95 is delivered. An operation of the rotation driving portion is controlled by the control portion 1. The transport rollers 21, 22, and 23 relay the printing medium 95 from the medium supplying portion 10 to the endless belt 48.

The endless belt 48, the belt rotating roller 24 and the belt driving roller 25 transport the printing medium 95 in the transport direction (+X axial direction) in the printing portion 40. Specifically, the endless belt 48 is formed in an endless shape by connecting both ends of a belt having a strip shape with each other and is hung on the belt rotating roller 24 and the belt driving roller 25. The endless belt 48 is held in a state where a predetermined tension is applied so that a portion between the belt rotating roller 24 and the belt driving roller 25 is parallel to a floor surface 99. An adhesive layer 29 which adheres the printing medium 95 is provided in a surface 48*a* (supporting surface) of the endless belt 48. The endless belt 48 supports (holds) the printing medium 95 which is supplied from the transport roller 22 and is in close contact with the adhesive layer 29 with the medium close contacting portion 60 to be described below. Accordingly, fabric, or the like which has elasticity can be treated as the printing medium 95.

The belt rotating roller 24 and the belt driving roller 25 support an inner peripheral surface 48*b* of the endless belt 48. A supporting portion which supports the endless belt 48 is configured to be provided between the belt rotating roller 24 and the belt driving roller 25.

The belt driving roller 25 includes a motor (not illustrated) which rotates and drives the belt driving roller 25. When the belt driving roller 25 rotates and drives, the endless belt 48 rotates according to the rotation of the belt driving roller 25, and then the belt rotating roller 24 rotates by the rotation of the endless belt 48. The printing medium 95 which is supported to the endless belt 48 is transported in the predetermined transport direction (+X axial direction) by the rotation of the endless belt 48 and thus an image is formed on the printing medium 95 at the printing portion 40 to be described below.

The printing medium 95 is mounted on a side(+Z axis side) in which the surface 48*a* of the endless belt 48 faces the printing portion 40 and the printing medium 95 is transported from the belt rotating roller 24 side to the belt driving roller 25 side along with the endless belt 48. In addition, only the endless belt 48 is moved from the belt driving roller 25 side to the belt rotating roller 24 side in a side (−Z axis side) in which the surface 48*a* of the endless belt 48 faces the cleaning unit 50. The endless belt 48 is described as being provided with the adhesive layer 29 which allows the endless belt 48 and the printing medium 95 to be in close contact with each other. However, it is not limited to this. For example, the endless belt may be an electrostatic adsorption type of an endless belt which absorbs the medium to the belt with static electricity.

The transport roller 26 peels off the printing medium 95 on which an image is formed from the adhesive layer 29 of the endless belt 48. The transport rollers 26 and 28 relay the printing medium 95 from the endless belt 48 to the medium collecting portion 30.

The medium collecting portion 30 collects the printing medium 95 which is transported by the medium transport portion 20. The medium collecting portion 30 includes a winding shaft portion 31 and a bearing portion 32. The winding shaft portion 31 has a cylindrical shape or a columnar shape and is provided to be rotatable in a circumferential direction. The printing medium 95 having a strip shape is wound into a roll shape in the winding shaft portion 31. The winding shaft portion 31 is detachably attached to the bearing portion 32. Therefore, the printing medium 95 in a state of being wound to the winding shaft portion 31 is removed along with the winding shaft portion 31.

The bearing portion 32 supports to be rotatable both ends of the winding shaft portion 31 in an axial direction. The medium collecting portion 30 includes a rotation driving portion (not illustrated) which rotates and drives the winding shaft portion 31. The rotation driving portion rotates the winding shaft portion 31 in a direction in which the printing medium 95 is wound. An operation of the rotation driving portion is controlled by the control portion 1.

Next, each portion which is provided along the medium transport portion 20 will be described.

The medium press portion 70 compresses the printing medium 95 and thus the height (thickness) of the printing medium 95 is lowered. The medium press portion 70 is provided between the transport roller 22 and the transport roller 23 which is disposed on an upstream of a discharging head 42 to be described below in the transport direction. Configuration of the medium press portion 70 will be described in detail later.

The medium close contacting portion 60 causes the printing medium 95 and the endless belt 48 to be in close contact with each other. The medium close contacting portion 60 is positioned on a downstream side (+X axis side) of the medium press portion 70 and is provided on an upstream (−X axis side) of the printing portion 40 in the transport direction of the printing medium 95. The medium close contacting portion 60 includes a pressing roller 61, a pressing roller driving portion 62 and a roller supporting portion 63. The pressing roller 61 has a cylindrical shape or a columnar shape and is provided to be rotatable in a circumferential direction. The pressing roller 61 is disposed to be intersected between an axial direction thereof and the transport direction with each other in order to rotate in a direction along the transport direction. The roller supporting portion 63 is provided on the inner peripheral surface 48*b* of the endless belt 48 which faces the pressing roller 61 with the endless belt 48 being inserted between the pressing roller 61 and the roller supporting portion 63.

The pressing roller driving portion 62 moves the pressing roller 61 in the transport direction (+X axis direction) and in a direction (−X axis direction) opposite to the transport direction while pressing the pressing roller 61 in a lower side of the vertical direction (−Z axis direction). The printing medium 95 which is overlapped with the endless belt 48 by the transport roller 23 is pressed against the endless belt 48 between the pressing roller 61 and the roller supporting portion 63. Accordingly, the printing medium 95 can be reliably adhered to the adhesive layer 29 which is provided on the surface 48*a* of the endless belt 48 and can prevent the printing medium 95 from being lifted from the endless belt 48.

The printing portion 40 is disposed on the upper side (+Z axis side) with respect to a disposition position of the endless belt 48. The printing portion 40 includes the discharging head 42 which discharges ink as an example of liquid in droplet form on the printing medium 95 disposed on the endless belt 48, a carriage 43 on which the discharging head 42 is mounted, and a carriage moving portion 41 which moves the carriage 43 in a width direction (Y axis direction) of the printing medium 95 which is intersected with the transport direction. A nozzle plate 44 on which a plurality of nozzle rows 45 are formed is provided on the discharging head 42. For example, four nozzle rows 45 are formed on the nozzle plate 44. Ink having a different color (for example, cyan: C, magenta: M, yellow: Y, black: K) is discharged per each nozzle row 45. The nozzle plate 44 faces the printing medium 95 which is transported by the endless belt 48.

The carriage moving portion 41 moves the discharging head 42 in a direction (the width direction (Y axis direction) of the printing medium 95) which is intersected with the transport direction of the printing medium 95. The carriage 43 is configured to be supported on a guide rail (not illustrated) which is disposed along Y axis direction and to be capable of reciprocating in the ±Y axis direction by the carriage moving portion 41. Mechanism of a combination of a ball screw and a ball nut, a linear guide mechanism, or the like can be adapted as a mechanism of the carriage moving portion 41, for example.

Further, a motor (not illustrated) as a power source for moving the carriage 43 along Y axis direction is provided in the carriage moving portion 41. When the motor is driven by the control of the control portion 1, the discharging head 42 reciprocates along the Y axis direction along with the carriage 43. The transport in the +X axis direction of the printing medium 95 by the medium transport portion 20 and the movement in the Y axis direction of the discharging head 42 are alternately repeated and thus an image or the like is printed on the printing medium 95. Although, as the discharging head 42, a serial-head type which discharges ink while moving in the width direction (±Y axis direction) of the printing medium 95 which is mounted on the movable carriage is included as an example in the embodiment, a line-head type which is disposed to extend in the width direction (Y axis direction) of the printing medium 95 and be fixed may be included.

The drying unit 27 is provided between the transport roller 26 and the transport roller 28. The drying unit 27 dries ink which is discharged on the printing medium 95 and an IR heater is included in the drying unit 27, for example and ink which is discharged on the printing medium 95 can be dried in a short time by driving the IR heater. Accordingly, the printing medium 95 having a strip shape on which an image or the like is formed can be wound around the winding shaft portion 31.

The cleaning unit 50 is disposed between the belt rotating roller 24 and the belt driving roller 25 in the X axis direction. The cleaning unit 50 cleans the surface 48*a* of the endless belt 48. The cleaning unit 50 includes a cleaning portion 51, a pressing portion 52 and a moving portion 53. The moving portion 53 is fixed to a predetermined position by integrally moving the cleaning unit 50 along the floor surface 99.

The pressing portion 52 is a lifting device which is configured as an air cylinder 56 and a ball bushing 57, for example and the cleaning portion 51 which is provided on the upper portion of the pressing portion 52 is in contact with the surface 48*a* of the endless belt 48. The cleaning portion 51 cleans the surface 48*a* (supporting surface) of the endless belt 48 which is hung in a state where a predetermined tension is applied between the belt rotating roller 24 and the belt driving roller 25 from the lower side (−Z axis direction).

The cleaning portion 51 includes a cleaning tank 54, a cleaning roller 58 and a plate 55. The cleaning tank 54 is a tank which stores a cleaning liquid used in cleaning of ink or foreign material attached to the surface 48*a* of the endless belt 48 and the cleaning roller 58 and the plate 55 are provided on an inside side of the cleaning tank 54. As the cleaning liquid, for example, water or water-soluble solvent (such as alcohol aqueous solution) can be used and a surfactant and an antifoaming agent may be added, if necessary.

When the cleaning roller 58 is rotated, a cleaning liquid is supplied to the surface 48*a* of the endless belt 48 and the cleaning roller 58 and the endless belt 48 slides. Accordingly, ink or fiber of fabric as the printing medium 95 attached to the endless belt 48 is removed by the cleaning roller 58.

The plate 55 can be made of flexible material such as silicon rubber, for example. The plate 55 is provided on a downstream side of the cleaning roller 58 in the transport direction of the endless belt 48. The cleaning liquid remaining on the surface 48*a* of the endless belt 48 is removed by the endless belt 48 and the plate 55 slides.

The printing apparatus 100 includes the notifying portion 92 which notifies with alarm. The notifying portion 92 according to the embodiment is a so-called Patlite (registered trademark) and notifies a state of the printing apparatus 100 by color, blinking pattern, or the like by control of the control portion 1. The notifying portion is a display device which is configured by a liquid crystal panel and may display notification content in letters or figures.

Configuration of a Medium Press Portion

Next, configuration of the medium press portion will be described.

Figure 2:
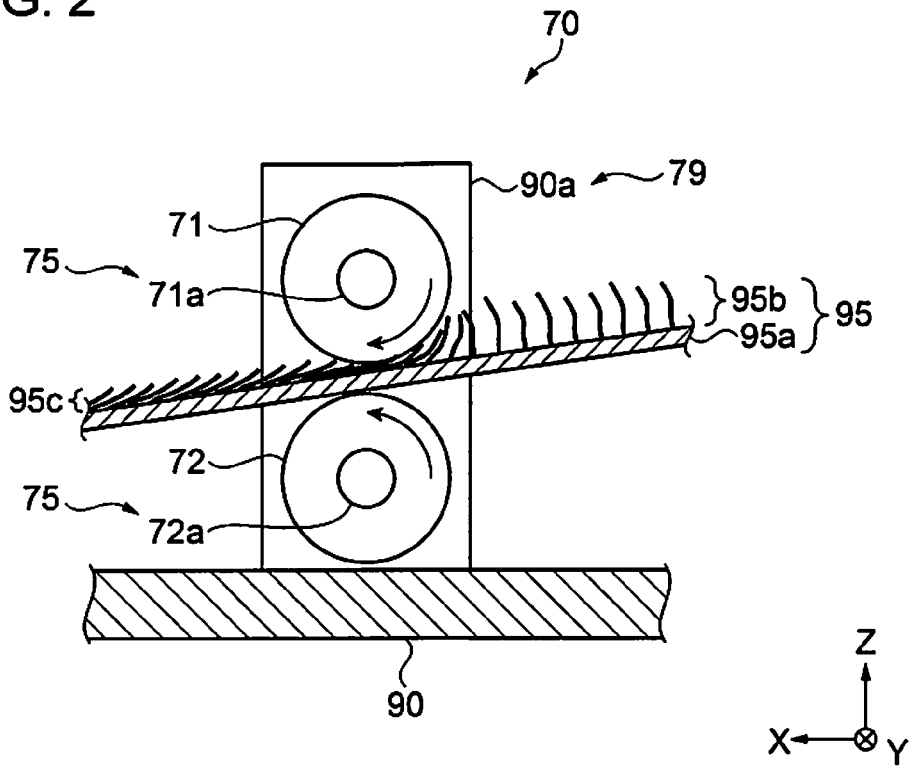
FIG. 2 is a sectional view illustrating configuration of a medium press portion.
Figure 3:
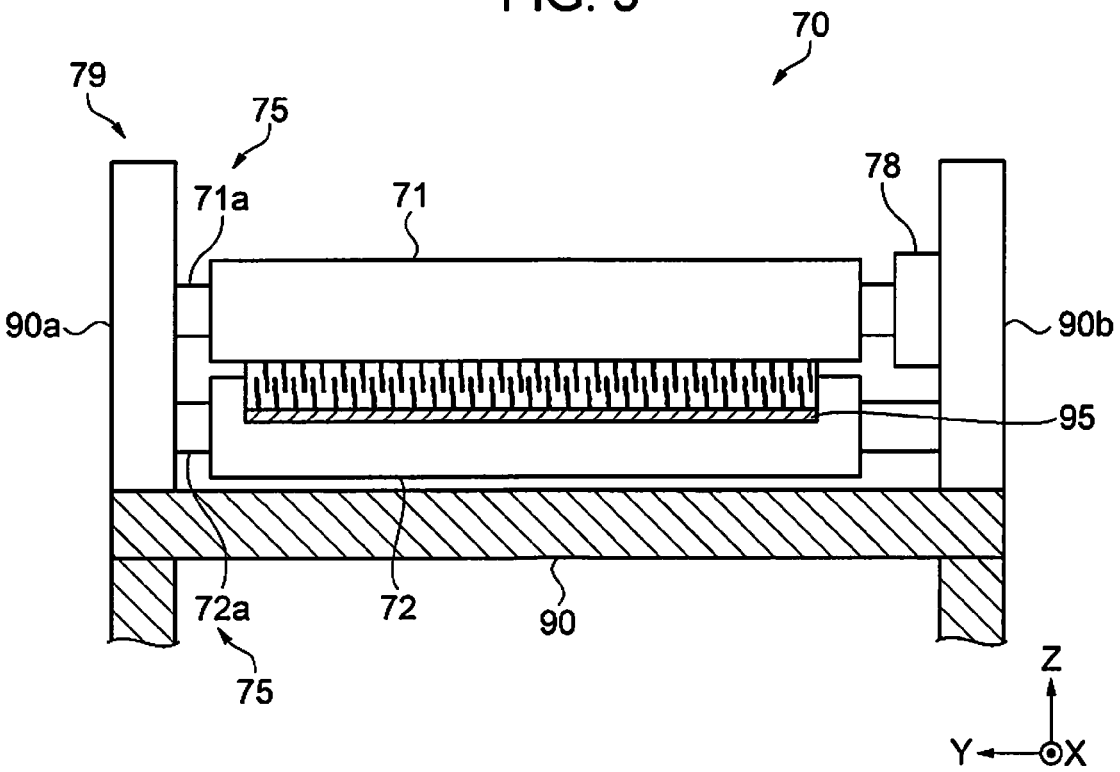
FIG. 3 is a side view illustrating configuration of a medium press portion.

FIG. 2 is a sectional view illustrating configuration of the medium press portion. FIG. 3 is a side view illustrating configuration of the medium press portion.

As illustrated in FIG. 2 and FIG. 3, the medium press portion 70 includes a first rotating roller 71 which is positioned to an upper side (+Z axis side) of the printing medium 95 and a second rotating roller 72 which is positioned to a lower side (−Z axis side) of the printing medium 95.

The first rotating roller 71 has a longer columnar shape than the width of the printing medium 95 and rotates about a rotating shaft 71*a*. The second rotating roller 72 has a longer columnar shape than the width of the printing medium 95 and rotates about a rotating shaft 72*a*. The second rotating roller 72 is provided to face the first rotating roller 71 and the printing medium 95 is sandwiched between the first rotating roller 71 and the second rotating roller 72.

The rotating shafts 71*a* and 72*a* are supported to be rotatable between frame portions 90*a* and 90*b* which are erected on an outside of the printing medium 95 in a side view from the X-axis direction. The medium press portion 70 includes a rotating/driving motor 78 which rotates and drives the rotating shaft 71*a*. The rotating/driving motor 78 rotates the first rotating roller 71 in synchronization with the driving of the medium transport portion 20 which transports the printing medium 95. The first rotating roller 71 rotates in clockwise direction in FIG. 2. The second rotating roller 72 follows the rotation of the first rotating roller 71 via the printing medium 95 and rotates in a direction opposite to the rotating direction of the first rotating roller. An operation of the rotating/driving motor 78 is controlled by the control portion 1.

The medium press portion 70 includes a medium pressing unit 79. The medium pressing unit 79 which presses the first rotating roller 71 against the second rotating roller 72 is provided on at least one of the frame portions 90*a* and 90*b*. Accordingly, the printing medium 95 which is sandwiched between the first rotating roller 71 and the second rotating roller 72 is pressed (compressed). The medium pressing unit 79 has a servo motor as a power source, for example and can adopt a mechanism which converts a rotating force of the servo motor into a pressing pressure in the vertical direction (Z axis direction) by a ball screw. The printing medium 95 can be pressed with a predetermined pressing pressure, by controlling the medium pressing unit 79 by the control portion 1. The medium pressing unit may have a configuration which presses the second rotating roller 72 against the first rotating roller 71. In addition, the medium pressing unit may have a configuration in which the first rotating roller 71 and the second rotating roller 72 are pressed with each other.

The medium press portion 70 includes a medium heating unit 75 which heats the printing medium 95. The medium heating unit 75 can adopt a heating member such as a mica heater, an oil heater, and a sheath heater, for example. These heating members are provided on the rotating shafts 71*a* and 72*a* and the first rotating roller 71 and the second rotating roller 72 are configured to be capable of being heated to a predetermined temperature. The printing medium 95 can heat with a predetermined temperature, by controlling the medium heating unit 75 by the control portion 1. In the embodiment, although the medium heating unit 75 is described as a configuration which is provided on the rotating shafts 71*a* and 72*a*, it is not limited to this. The medium heating unit may be configured to be provided on any one of the rotating shaft 71*a* and the rotating shaft 72*a*. In addition, the medium heating unit 75 may be configured to be provided on at least one of the first rotating roller 71 and the second rotating roller 72.

As illustrated in FIG. 2, the printing medium 95 is configured with base fabric 95*a* and the fluff layer 95*b*. The fluff which is dense from the base fabric 95*a* is generated in the fluff layer 95*b* and the released fluff or long fluff projects. In a state where the first rotating roller 71 and the second rotating roller 72 of the medium press portion 70 press the printing medium 95, when the printing medium 95 transports in the transport direction (+X direction), the fluff layer 95*b* is compressed and thus the fluff layer 95*c* in which the height of the fluff is lowered is formed. Accordingly, the printing medium 95 of which height is lowered can be supplied to the printing portion 40. The compressing efficiency of the fluff layer 95*b* of the printing medium 95 can be improved by driving the medium heating unit 75 and then the printing medium 95 being compressed while bring heated.

Figure 4:
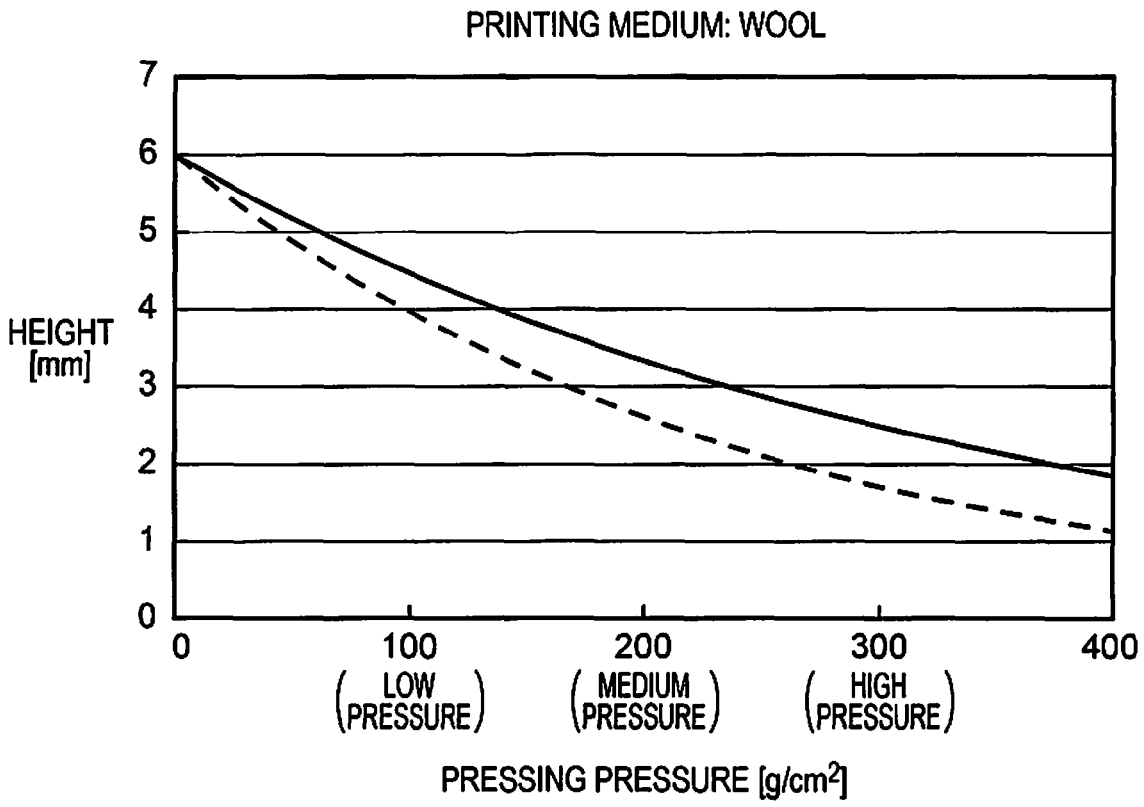
FIG. 4 is a diagram illustrating a relationship between pressing pressure which is applied to the printing medium and a height of the printing medium.

FIG. 4 is a diagram illustrating a relationship between pressing pressure which is applied to the printing medium and a height of the printing medium. The horizontal axis of FIG. 4 indicates the pressing pressure which is applied to the printing medium 95 by the medium pressing unit 79. The vertical axis of FIG. 4 indicates a height (thickness) of the printing medium 95 when the printing medium 95 is transported from the medium press portion 70 to the printing portion 40 side. FIG. 4 is illustrated a case where wool is used as the printing medium 95. A solid line indicated in FIG. 4 indicates the height of wool in a case where the pressing pressure is applied to the wool (printing medium 95) and a dashed line indicates the height of wool in a case where heat and pressing pressure is applied to wool.

The height of the printing medium 95 indicated as the pressing pressure "0" in FIG. 4 represents a height before the printing medium 95 in which the fluff layer 95*b* is applied to the base fabric 95*a* is pressed (see FIG. 2). As illustrated in FIG. 4, when the pressing pressure which presses the printing medium 95 of wool, the height of the printing medium 95 in which the fluff layer 95*b* is compressed is lowered (base fabric 95*a*+fluff layer 95*c*) according to the pressing pressure. In a case of pressing while heating the printing medium 95, the height of the printing medium 95 can be further lowered, since the fluff layer 95*b* is further compressed. For example, when the printing medium 95 of wool presses with the pressing pressure of 300 g/cm$^2$, the height of the printing medium 95 is compressed from 6 mm to about 2.5 mm. The height of the printing medium 95 can be compressed to about 1.7 mm, by compressing while heat is applied to the printing medium 95. In FIG. 4, although data in a case of wool as an example of the printing medium 95 is illustrated, data corresponding to FIG. 4 which corresponds to various printing media is stored in a storage portion 5.

Electrical Configuration

Figure 5:
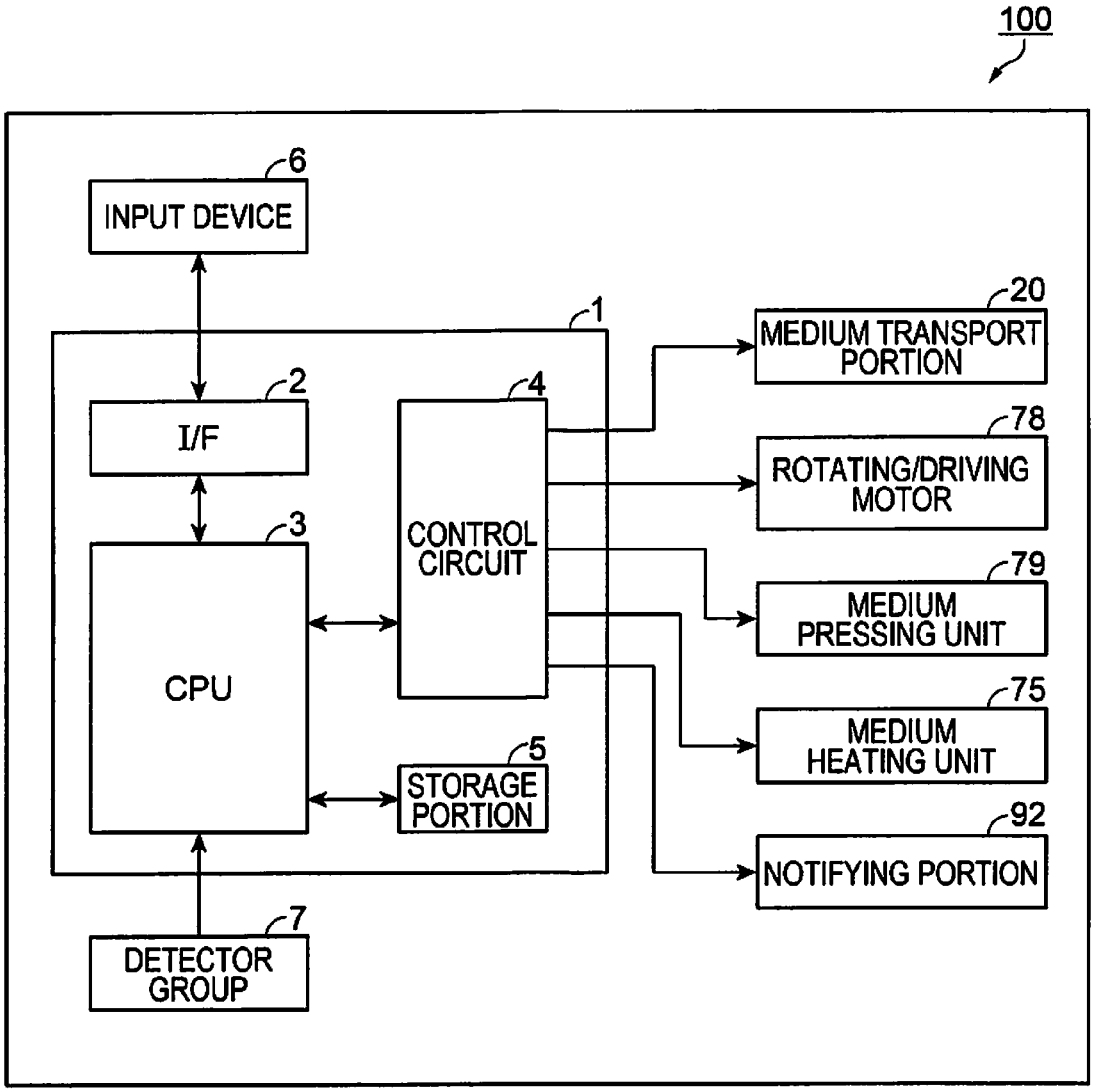
FIG. 5 is an electrical block diagram illustrating electric configuration of the printing apparatus.

FIG. 5 is an electrical block diagram illustrating electric configuration of the printing apparatus. Next, the electric configuration of the printing apparatus 100 will be described.

The printing apparatus 100 includes an input device 6 as an input unit which inputs various printing conditions, or the like and the control portion 1 which performs control of each portion of the printing apparatus 100. As the input device 6, Desktop or laptop personal computer (PC), tablet devices, portable devices, or the like can be used. The input device 6 may be provided separately from the printing apparatus 100.

The control portion 1 is configured to include a control circuit 4, an interface portion (I/F) 2, and a central processing unit (CPU) 3, and a storage portion 5. The interface portion 2 performs sending and receiving of data between the input device 6 which handles input signals and images and the control portion 1. The CPU 3 is an arithmetic processing device for performing input signal processing from various detector group 7 and control of entirety of the printing apparatus 100.

The storage portion 5 ensures area for storing program of the CPU 3, working areas, or the like and includes a storage element such as a random access memory (RAM), and an electrically erasable programmable read-only memory (EEPROM). In addition, a medium pressing table to be described below is stored in the storage portion 5.

The control portion 1 outputs control signals from the control circuit 4 and controls driving of various motors included in the medium transport portion 20 and thus moves the printing medium 95 in the transport direction. The control portion 1 outputs control signals from the control circuit 4 and controls driving of the rotating/driving motor 78 and thus rotates the first rotating roller 71. The control portion 1 outputs control signals from the control circuit 4 and controls the medium pressing unit 79 and thus presses the first rotating roller 71 against the second rotating roller 72. The control portion 1 outputs control signals from the control circuit 4 and controls the medium heating unit 75 and thus heats the first rotating roller 71 and the second rotating roller 72. The control portion 1 outputs control signals from the control circuit 4 according to the printing condition which is input to the input device 6 and thus notifies alarm to the notifying portion 92. In addition, the control portion 1 controls each device which is not illustrated.

Method for Compressing Printing Medium

Figures 6, 7:
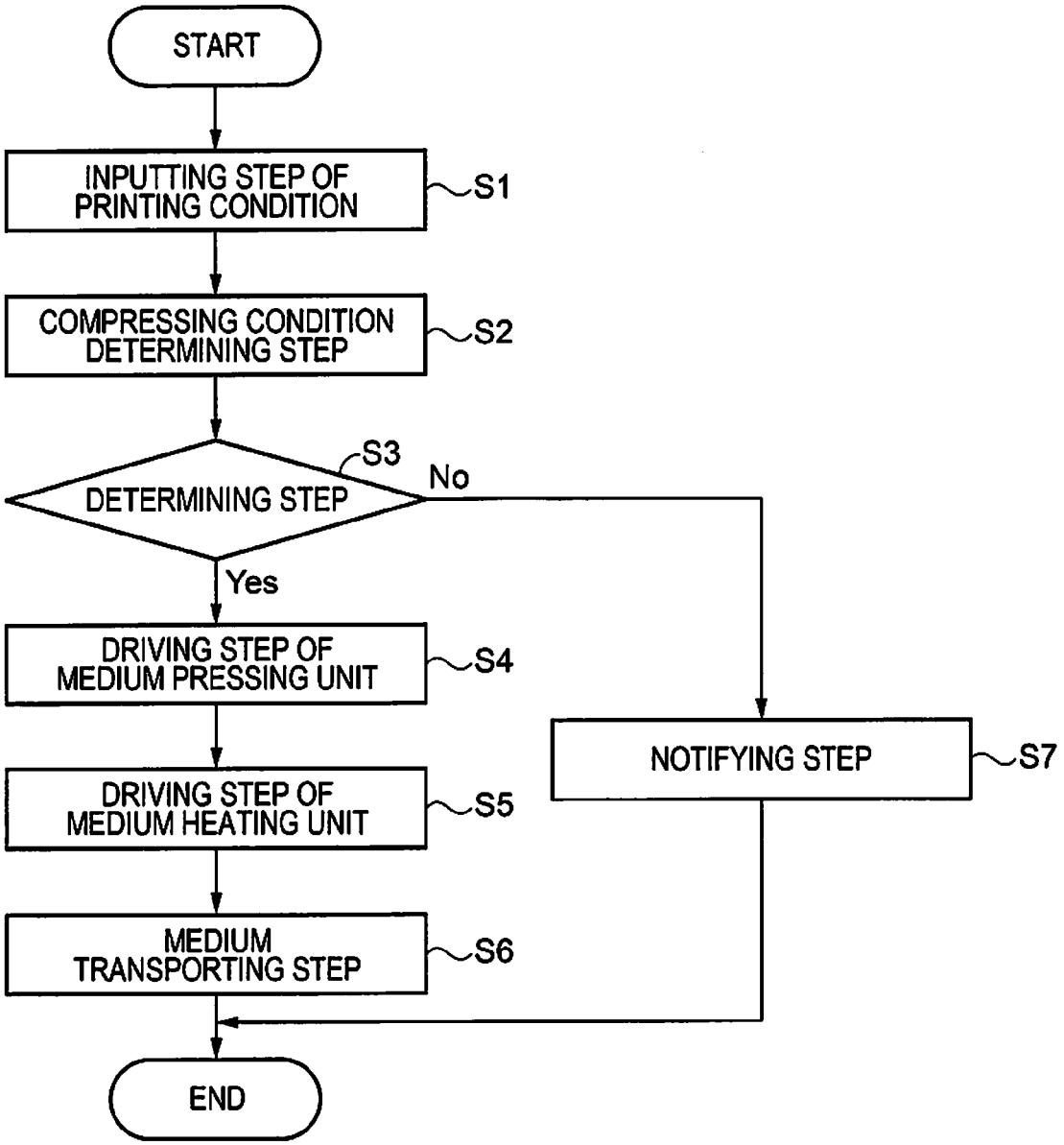
FIG. 6 is a flow chart describing a method for compressing the printing medium.
FIG. 7 is a medium pressing table indicating a temperature and the pressing pressure when the printing medium is compressed.

FIG. 6 is a flow chart describing a method for compressing the printing medium. FIG. 7 is a medium pressing table indicating a temperature and a pressing pressure when the printing medium is compressed.

Next, The method for compressing the printing medium 95 will be described.

Step S1 is an inputting step of printing condition. A user inputs the printing condition by the input device 6. As the printing condition, for example, there are a distance WG between the endless belt 48 and the discharging head 42 (hereinafter, referred to as gap WG), the type of the printing medium 95, selection of presence or absence of the medium heating to be described below, or the like.

Step S2 is a compression condition determining step for determining a condition when the printing medium 95 is compressed based on the input printing condition. The type of the printing medium 95, range of the pressing pressure which is applied to the printing medium 95, and the temperature which can be applied to the printing medium 95 is indicated in the medium pressing table illustrated in FIG. 7. The range of the pressing pressure is predetermined in consideration of texture of the printing medium 95 after press. The temperature is determined by heat resistance of various printing media 95.

In step S2, the pressing pressure and the temperature is determined for controlling the pressing pressure of the medium press portion 70 to be changeable (medium pressing unit 79) and the temperature of the medium heating unit 75 according to the input printing condition at the step S1 by the control portion 1. The control portion 1 refers data (see FIG. 4) which indicates a relationship between the pressing pressure applied to the printing medium 95 and the height of the printing medium 95 which are stored in the storage portion 5 according to the selected type of the printing medium, and the medium pressing table. For example, in a case where wool is selected as the printing medium 95, the control portion 1 can change the pressing pressure of the medium pressing unit 79 from a range of "medium pressure" to a range of "high pressure" by the medium pressing table and can change the temperature of the medium heating unit 75 to "low medium temperature" or the driving of the medium heating unit to "OFF".

For example, in step S1, in a case where the printing medium 95 is set to wool, the gap WG is set to 3 mm, and the presence or absence of the medium heating is set to "there is medium heating", the control portion 1 determines the setting temperature of the medium heating unit 75 to "low medium temperature". With reference to a dashed line indicating that there is heating in FIG. 4, the pressing pressure of the medium pressing unit 79 is determined to "medium pressure" in which the printing medium 95 is compressed to a height which subtracts a predetermined value from the gap WG.

In addition, For example, in step S1, in a case where the printing medium 95 is set to wool, the gap WG is set to 3 mm, and the presence or absence of the medium heating is set to "there is no medium heating", the control portion 1 determines the driving of the medium heating unit 75 to "OFF". With reference to a solid line indicating that there is no heating in FIG. 4, the pressing pressure of the medium pressing unit 79 is determined to "high pressure" in which the printing medium 95 is compressed to a height which subtracts a predetermined value from the gap WG.

Step S3 is a determining step for determining whether or not the printing condition is appropriate. In a case where input condition is appropriate (step S3: Yes), the process proceeds to step S4. In a case where the input condition is not appropriate (step S3: No), the process proceeds to step S7. For example, in the step S1, in a case where the printing medium 95 is set to wool, the gap WG is set to 2.5 mm, and the presence or absence of the medium heating is set to "there is no medium heating", the pressing pressure which is required to compress the printing medium 95 to a height which subtracts a predetermined value from the gap WG becomes "high pressure" or more which is a upper limit of the pressing pressure of wool (see solid line in FIG. 4). Therefore, the control portion 1 determines the input printing condition to be inappropriate. Here, for convenience of description, although step S2 and step S3 are described as two steps, the two steps proceed substantially at the same time.

Step S4 is a driving step of the medium pressing unit. The control portion 1 controls and drives the medium pressing unit 79 by the pressing pressure which is determined at step S2.

Step S5 is a driving step of the medium heating unit. The control portion 1 controls and drives the medium heating unit 75 by the setting temperature which is determined at step S2. In a case where the presence or absence of the medium heating is set to "there is no medium heating", the control portion 1 determines the driving of the medium heating unit 75 to "OFF". The steps S4 and S5 may be performed at the same time, and may be performed in reverse order.

Step S6 is a medium transporting step for transporting the printing medium. The fluff layer 95*b* of the printing medium 95 is compressed to a fluff layer 95*c* in the medium press portion 70 and thus the height of the printing medium 95 is further lowered than the gap WG by the control portion 1 driving the medium transport portion 20 and the printing medium 95 transporting in the transport direction (+X direction) in the medium press portion 70. The compressed printing medium 95 is transported to the printing portion 40 and an image, or the like is printed on the printing medium 95. Accordingly, opportunity of contact between the discharging head 42 and the fluff layer 95*c* of the printing medium 95 with each other is reduced and thus defects such as nozzle missing that the droplets are not discharged and landing deviation of the discharged droplets are less likely to be generated. In addition, even if the printing medium 95 has a high fluff layer 95*b*, a clear image can be printed on the printing medium 95 since the gap WG (discharging head 42) can set to be lowered than the printing medium 95 before compression. Accordingly, an image being excellent in printing quality is formed on the printing medium 95 such as fabric. The steps of step S4 to step S6 correspond to the medium compressing step for compressing the printing medium 95.

Step S7 is a notifying step for notifying to the notifying portion 92. The control portion 1 notifies alarm to the notifying portion 92 in a case where the height of the printing medium 95 cannot be compressed to be further lowered than the gap WG, in the input printing conditions, for example. For example, in a case of an example described in step S3, the control portion 1 notifies alarm which corresponds to "gap WG" and "there is no medium heating" which are input items determined as inappropriate inputs. Accordingly, the print deteriorated in image quality can be prevented from being performed in advance.

In the embodiment, although the pressing pressure of the medium pressing unit and the temperature of the medium heating unit are described as configuration (method) which can change. However, it is not limited to this. At least one of the pressing pressure of the medium pressing unit and the temperature of the medium heating unit may be configuration (method) which is controlled to be changeable.

As described above, according to the printing apparatus 100 related to the embodiment, the following effects can be obtained.

The printing apparatus 100 includes the medium press portion 70 which compresses the fluff of the fluff layer 95*b* of the printing medium 95. The control portion 1 controls the medium pressing unit 79 of the medium press portion 70 and the medium heating unit 75 corresponding to the printing condition of the distance (gap WG) between the endless belt 48 and he discharging head 42, the type of the printing medium 95, and the presence and absence of the medium heating, or the like, input to the input device 6. The fluff layer 95*b* is compressed to a fluff layer 95*c* and thus the height of the printing medium 95 is further lowered than the gap WG by the printing medium 95 transporting in the transport direction in the medium press portion 70. Accordingly, opportunity of contact between the discharging head 42 and the fluff layer 95*c* of the printing medium 95 with each other is reduced and thus defects such as nozzle missing that the droplets are not discharged and landing deviation of the discharged droplets are less likely to be generated. In addition, even if the printing medium 95 has a high fluff layer 95*b*, a clear image can be printed on the printing medium 95 since the gap WG (discharging head 42) can set to be further lowered than the printing medium 95 before compression. Accordingly, an image being excellent in printing quality is formed on the printing medium 95 such as fabric. Therefore, the printing apparatus 100 which improves the printing quality can be provided.

The printing apparatus 100 includes a notifying portion 92 which notifies with alarm according to the input printing condition. Accordingly, the print deteriorated in image quality can be prevented from being performed in advance, since the control portion 1 notifies alarm to the notifying portion 92 in a case where the height of the printing medium 95 cannot be compressed to be further lowered than the gap WG, in the input printing conditions, for example.

According to the printing apparatus 100, the method for compressing the printing medium 95 includes a compressing condition determining step for determining a condition when the printing medium 95 is compressed according to the printing condition which is input to the input device 6; and a medium compressing step for compressing the printing medium 95. In the compressing condition determining step, the control portion 1 refers the medium pressing table stored in the storage portion 5, and determines the pressing pressure and temperature which are applied to the printing medium 95 in the medium press portion 70 corresponding to the printing condition of the distance (gap WG) between the endless belt 48 and he discharging head 42, the type of the printing medium 95, and the presence and absence of the medium heating, or the like, input to the input device 6. In the medium compressing step, the control portion 1 controls the medium pressing unit 79 of the medium press portion 70 and the medium heating unit 75 based on the pressing pressure and the temperature determined in the compressing condition determining step. The fluff layer 95*b* is compressed to a fluff layer 95*c* and thus the height of the printing medium 95 is further lowered than the gap WG by the printing medium 95 transporting in the transport direction in the medium press portion 70. Accordingly, opportunity of contact between the discharging head 42 and the fluff layer 95*c* of the printing medium 95 with each other is reduced and thus defects such as nozzle missing that the droplets are not discharged and landing deviation of the discharged droplets are less likely to be generated. In addition, even if the printing medium 95 has a high fluff layer 95*b*, a clear image can be printed on the printing medium 95 since the gap WG (discharging head 42) can set to be further lowered than the printing medium 95 before compression. Accordingly, an image being excellent in printing quality is formed on the printing medium 95 such as fabric. Therefore, the method for compressing the printing medium 95 which can improve the printing quality can be provided.

The invention is not limited to the embodiments described above, and it is possible to add various changes or improvements to the embodiments described above. Modification examples will be described below.

MODIFICATION EXAMPLE 1

Figure 8:
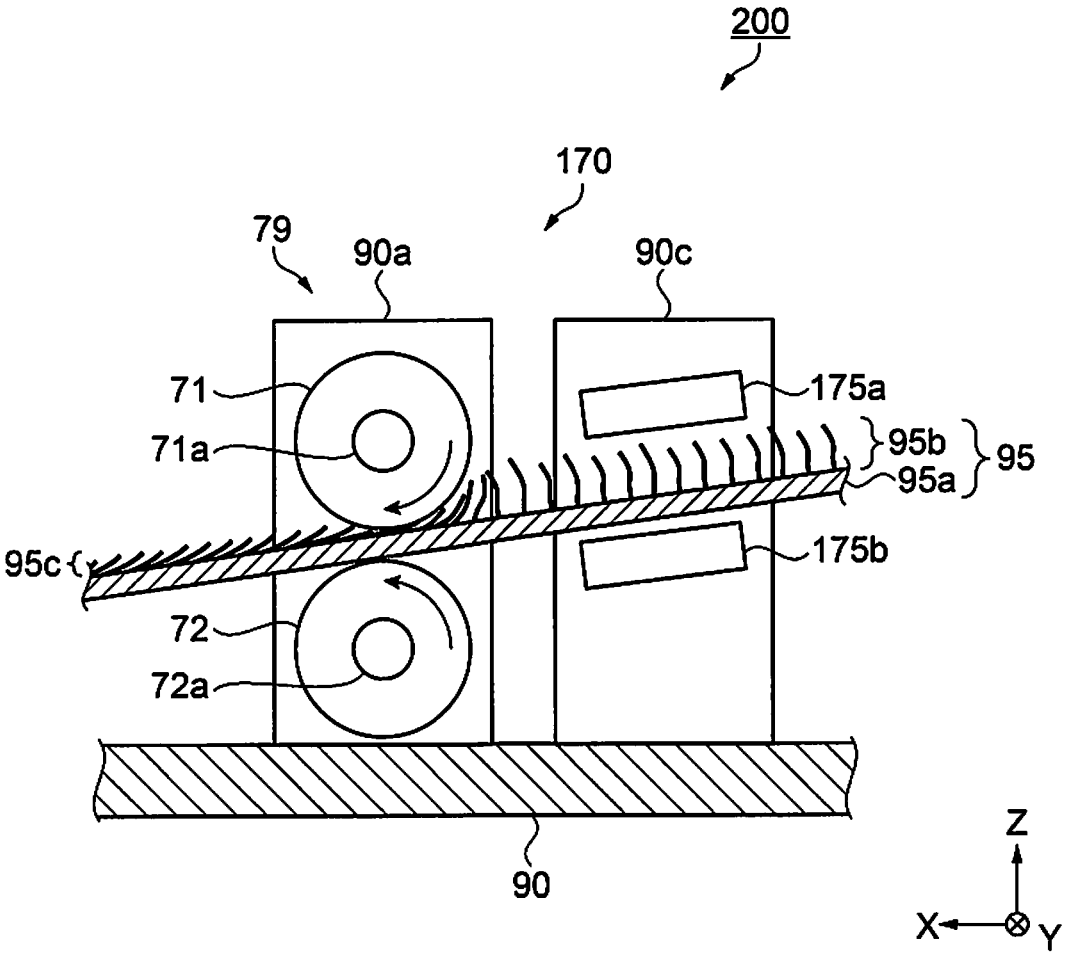
FIG. 8 is a sectional view illustrating configuration of a medium press portion according to Modification example 1.

FIG. 8 is a sectional view illustrating configuration of a medium press portion according to Modification example 1.

According to the embodiments described above, as illustrated in FIG. 2, although it is described that the medium heating unit 75 is provided in the rotating shafts 71*a* and 72*a*, it is not limited to the configuration.

Hereinafter, a printing apparatus 200 according to Modification example 1 will be described. For the same components as in the embodiment, the same number is used, and a duplicate description thereof will be omitted.

The medium press portion 170 includes a medium heating units 175*a* and 175*b* which heat the printing medium 95. As illustrated in FIG. 8, a pair of medium heating units 175*a* and 175*b* is provided which heat the printing medium 95 from the upper side (±Z axis direction) in the upstream side of the first rotating roller 71 and the second rotating roller 72 which press the printing medium 95 in the transport direction of the printing medium 95. The medium heating units 175*a* and 175*b* are a rectangular parallelepiped having a longer plate shape than the width of the printing medium 95 and are supported between a frame portion 90*c* which is erected on the outside of the printing medium 95 and a frame (not illustrated) in the Y axis direction (width direction).

As the medium heating units 175*a* and 175*b*, a heating member such as an IR heater may be adopted, for example. The medium heating units 175*a* and 175*b* can heat the printing medium 95 to a predetermined temperature, by controlling the medium heating units 175*a* and 175*b* by the control portion 1. The printing medium 95 which is heated in the medium heating units 175*a* and 175*b* is transported to the downstream side by driving of the medium transport portion 20 and then is pressed in the first rotating roller 71 and the second rotating roller 72. The compressing efficiency of the fluff layer 95*b* of the printing medium 95 can be improved by heating the printing medium 95 in the medium heating units 175*a* and 175*b*. In the embodiment, although the medium heating units 175*a* and 175*b* are described as a configuration which is provided on both ends of the printing medium 95 in the vertical direction, it is not limited to this. The medium heating unit may be configured to be provided on any one of the upper side and the lower side of the printing medium 95.

MODIFICATION EXAMPLE 2

Figure 9:
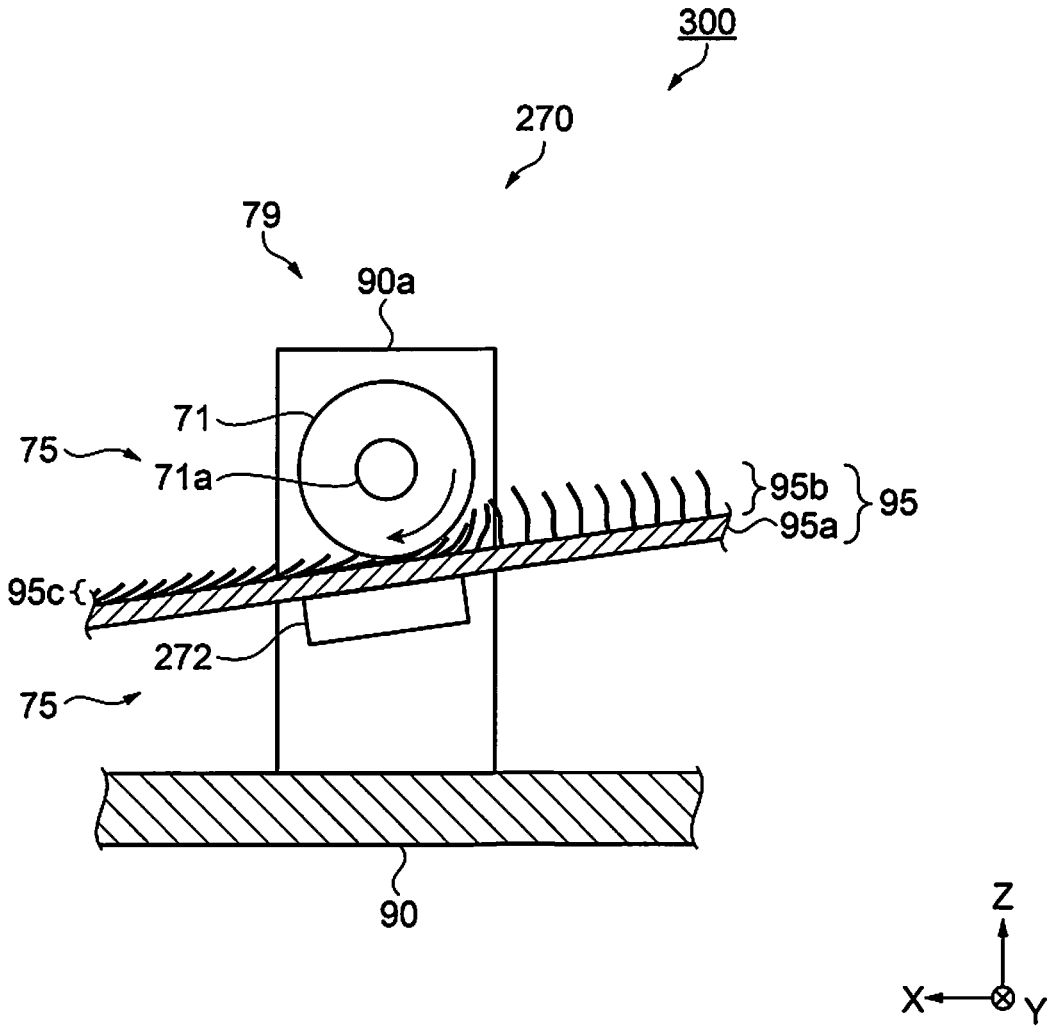
FIG. 9 is a sectional view illustrating configuration of a medium press portion according to Modification example 2.

FIG. 9 is a sectional view illustrating configuration of a medium press portion according to Modification example 2.

According to the embodiments described above, as illustrated in FIG. 2, although it is described that the medium press portion 70 includes the first rotating roller 71 and the second rotating roller 72 which press the printing medium 95, it is not limited to the configuration.

Hereinafter, a printing apparatus 300 according to Modification example 2 will be described. For the same components as in the embodiment, the same number is used, and a duplicate description thereof will be omitted.

As illustrated in FIG. 9, the medium press portion 270 includes a press supporting portion 272 which receives press of the first rotating roller 71. The press supporting portion 272 is a rectangular parallelepiped having a longer plate shape than the width of the printing medium 95 and are supported between a frame portions 90*a* and 90*b* which are erected on the outside of the printing medium 95 in the Y axis direction (width direction). The press supporting portion 272 includes the medium heating unit 75 which is provided along the lower surface (surface of −Z axis side) of the base fabric 95*a* of the printing medium 95.

The medium pressing unit 79 presses the first rotating roller 71 against the press supporting portion 272. When the printing medium 95 is transported in the transport direction (+X axis direction), the printing medium 95 is pressed between the press supporting portion 272 and the first rotating roller 71. Accordingly, the fluff layer 95*b* of the printing medium 95 is compressed and thus the height of the printing medium 95 can be lowered. In the modification example, although the medium heating unit 75 is described as a configuration which is provided on the press supporting portion 272 and the first rotating roller 71, it is not limited to this. The medium heating unit 75 may be configured to be provided on at least one of the first rotating roller 71 and the press supporting portion 272.

MODIFICATION EXAMPLE 3

Figure 10:
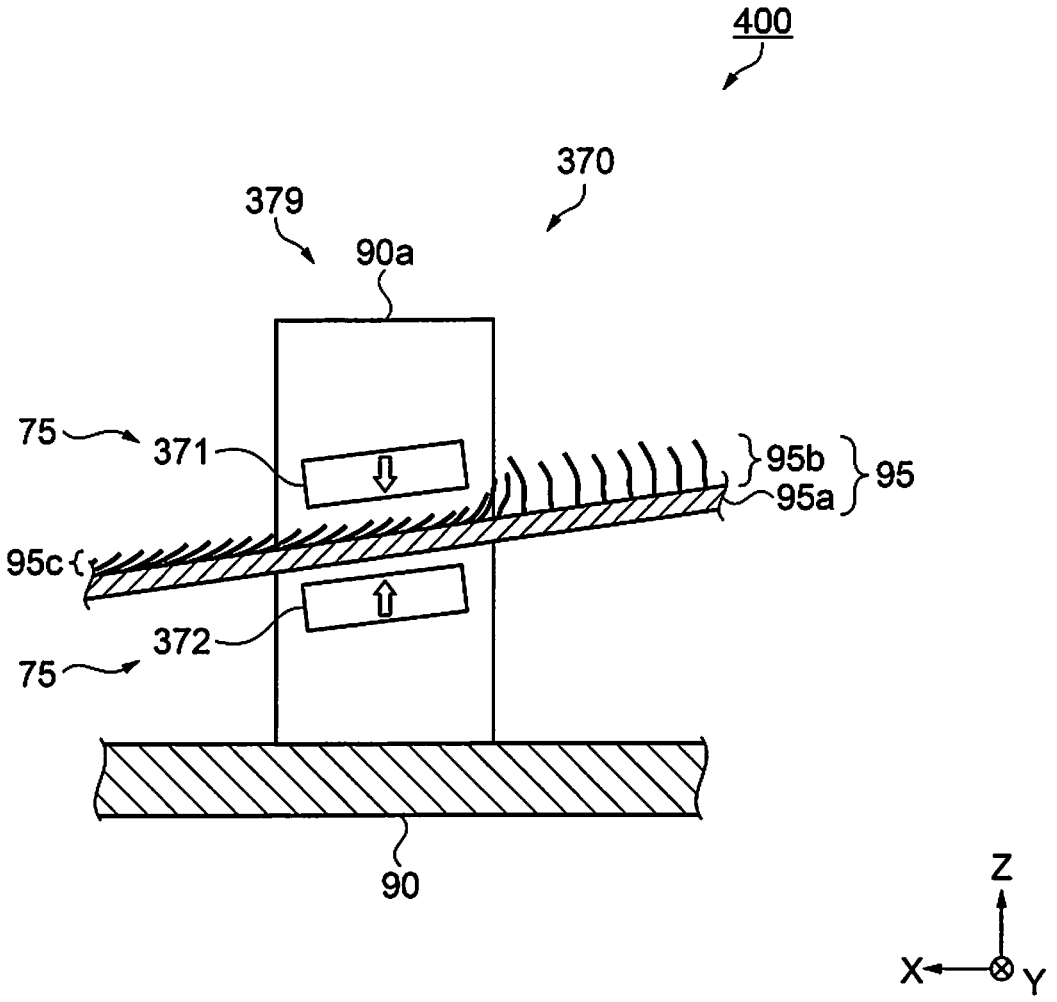
FIG. 10 is a sectional view illustrating configuration of a medium press portion according to Modification example 3.

FIG. 10 is a sectional view illustrating configuration of a medium press portion according to Modification example 3.

According to the embodiments described above, as illustrated in FIG. 2, although it is described that the medium press portion 70 includes the first rotating roller 71 and the second rotating roller 72 which press the printing medium 95, it is not limited to the configuration.

Hereinafter, a printing apparatus 400 according to Modification example 3 will be described. For the same components as in the embodiment, the same number is used, and a duplicate description thereof will be omitted.

As illustrated in FIG. 10, the medium press portion 370 includes a first press portion 371 which is positioned to an upper side (+Z axis side) of the printing medium 95 and a second press portion 372 which is positioned to a lower side (−Z axis side) of the printing medium 95. The first press portion 371 and the second press portion 372 are rectangular parallelepipeds having a longer plate shape than the width of the printing medium 95 and are supported between a frame portions 90*a* and 90*b* which are erected on the outside of the printing medium 95 in the Y axis direction (width direction).

The medium pressing unit 379 which presses the first press portion 371 and the second press portion 372 in the direction facing each other is provided on at least one of the frame portions 90*a* and 90*b*. The medium pressing unit 379 has a servo motor as a power source, for example and can adopt a mechanism which converts a rotating force of the servo motor into a pressing pressure in the vertical direction (Z axis direction) by a ball screw. The medium pressing unit 379 is controlled by the control portion 1.

The driving of the medium pressing unit 379 is controlled to be synchronized with the driving of the medium transport portion 20. Specifically, the control portion 1 moves the printing medium 95 by a predetermined transport amount in the transport direction by driving the medium transport portion 20. The control portion 1 controls the discharging head 42 and the carriage moving portion 41 and thus moves the discharging head 42 in an intersecting direction with the transport direction while ink discharges on the printing medium 95 which is stopped. By alternately repeating this, an image, or the like is printed on the printing medium 95. In other words, the control portion 1 repeats the transport and stop of the printing medium 95.

The printing medium 95 which is positioned between the first press portion 371 and the second press portion 372 can be pressed with a predetermined pressure, by the control portion 1 driving the medium pressing unit 379 when the transport of the printing medium 95 is stopped. The fluff layer 95*c* of which the height of the fluff is lowered is formed by the control portion 1 repeating the driving of the medium transport portion 20 and the driving of the medium pressing unit 379 and thus the fluff layer 95*b* of the printing medium 95 being sequentially compressed. Accordingly, the printing medium 95 of which height is lowered can be supplied to the printing portion 40.

The medium press portion 370 includes a medium heating unit 75 which heats the printing medium 95. The heating member described in the embodiment is provided on the first press portion 371 and the second press portion 372 and is configured to be capable of heating the first press portion 371 and the second press portion 372 to a predetermined temperature. The compressing efficiency of the fluff layer 95*b* of the printing medium 95 can be improved by the medium pressing unit 379 and the medium heating unit 75 being driven and then the printing medium 95 being compressed while being heated. In the modification embodiment, although the medium heating unit 75 is described as a configuration which is provided on the first press portion 371 and the second press portion 372, it is not limited to this. The medium heating unit may be configured to be provided on any one of the first press portion 371 and the second press portion 372.

This application claims priority under 35 U.S.C. § 119 to Japanese Patent Application No. 2016-009510, filed Jan. 21 2016. The entire disclosure of Japanese Patent Application No. 2016-009510 is hereby incorporated herein by reference.

What is claimed is:

1. A printing apparatus, comprising:

a discharging head which discharges liquid on a printing medium mounted on an endless belt;

a transport unit which transports the printing medium in a transport direction, the transport unit including the endless belt;

a medium press portion which is provided on an upstream side of the discharging head and the endless belt in the transport direction and includes a medium pressing unit which compresses the printing medium; and a control portion which controls the medium press portion, wherein the control portion stores a prediction data that predicts a height of the printing medium after being compressed by the medium cress unit, and the control portion controls the medium press portion based on the prediction data.

2. The printing apparatus according to claim 1, further comprising:

an input unit to which a printing condition for printing the printing medium is input, the printing condition including a type of the printing medium, wherein the control portion controls pressing pressure of the medium pressing unit to be changeable according to the printing condition.

3. The printing apparatus according to claim 2, wherein the medium press portion includes a medium heating unit which heats the printing medium, and wherein the control portion controls temperature of the medium heating unit to be changeable according to the printing condition.

4. The printing apparatus according to claim 3, wherein the printing condition further includes a distance between the endless belt and the discharging head, and wherein the control portion controls at least one of the pressing pressure and the temperature to be changeable according to the printing condition.

5. The printing apparatus according to claim 2, further comprising:

a notifying portion which notifies with alarm according to the input printing condition.

6. A method for compressing a printing medium in a printing apparatus which includes an discharging head which discharges liquid on a printing medium mounted on an endless belt, a transport unit which transports the printing medium in a transport direction, a medium press portion which is provided on an upstream side of the discharging head in the transport direction and includes a medium pressing unit which compresses the printing medium, an input unit to which printing condition is input, and a control portion which controls the medium press portion, the method comprising:

determining a compressing condition in which the printing medium is compressed, according to the printing condition and based on a prediction data that predicts a height of the printing medium after being compressed by the medium press unit and that is stored in the control portion; and compressing, based on the compressing condition that has been determined, the printing medium with the medium pressing unit that is provided on an upstream side of the endless belt in the transport direction.

7. The printing apparatus according to claim 1, further comprising:

a medium close contacting portion which is provided on a downstream side of the medium press portion in the transport direction and on the upstream side of the discharging head in the transport direction and which presses the printing medium against the endless belt.

8. The printing apparatus according to claim 2, wherein the printing condition further includes a distance between the endless belt and the discharging head, and the control portion controls the medium press portion so that the height of the printing medium after being compressed by the medium press unit is lower than the distance between the endless belt and the discharging head.

9. The printing apparatus according to claim 5, wherein the notifying portion notifies with alarm in a case where the height of the printing medium cannot be compressed to be lower than the distance between the endless belt and the discharging head.

10. The printing apparatus according to claim 2, wherein the printing condition further includes a type of material that forms the printing medium.

11. The printing apparatus according to claim 10, wherein the type of material that forms the printing medium includes at least one of wool, cotton, and polyester.

* * * * *